United States Patent [19]

Larkin et al.

[11] 4,368,765

[45] Jan. 18, 1983

[54] FLEXIBLE BAG WITH RECESSED SCRAPLESS HANGER

[75] Inventors: Mark E. Larkin, Lindenhurst; Edward S. Tripp, Grayslake, both of Ill.

[73] Assignee: Abbott Laboratories, North Chicago, IL 60064

[21] Appl. No.: 215,969

[22] Filed: Dec. 12, 1980

[51] Int. Cl.[3] ..... B65D 33/10; B65D 33/14

[52] U.S. Cl. ..... 150/1; 229/54 R; 128/214 D

[58] Field of Search ..... 150/0.5, 1, 8, 9, 12; 206/525, 804, 806, 634, 609; 215/DIG. 3; 229/54 R, 52 B; 128/214 D, 272, 275, DIG. 24; 248/75, 95

[56] References Cited

U.S. PATENT DOCUMENTS

| | | | |
|---|---|---|---|
| 3,205,889 | 9/1965 | Alder et al. | 128/272 |
| 3,464,619 | 9/1969 | Nordstrom | 229/52 B |
| 3,529,598 | 9/1970 | Waldman et al. | 128/275 |
| 3,797,731 | 3/1974 | Weldon | 229/52 B |
| 3,915,212 | 10/1975 | Bujan et al. | 150/8 |
| 3,992,706 | 11/1976 | Tunney et al. | 340/239 R |
| 4,027,842 | 6/1977 | Mittleman | 248/75 |
| 4,049,033 | 9/1977 | Ralston | 150/0.5 |
| 4,105,028 | 8/1978 | Sadlier | 128/214 |
| 4,119,268 | 10/1978 | Segura | 229/54 R |
| 4,140,162 | 2/1979 | Gajewski et al. | 150/1 |
| 4,199,062 | 4/1980 | Johnston et al. | 206/525 |

OTHER PUBLICATIONS

"Plastics the Better Way", Plastics World, May 1979, pp. 67, 72.

*Primary Examiner*—William Price
*Assistant Examiner*—Sue A. Weaver
*Attorney, Agent, or Firm*—Neil E. Hamilton; Robert L. Niblack

[57] ABSTRACT

A hanger construction for a collapsible container for medical fluids which is fabricated in such a manner that it is scrapless and positioned within the confines of the container. The hanger is formed with tear and hinge lines so that one or more tab portions are easily torn from and displaced from the bag surface to provide a hanger hole. Hinge lines are positioned to afford a biasing of the displaced portions outwardly from the bag surface so that they will not "reclose" in the hanger hole. A tear point is utilized for ease in initiating the tearing away of the tab portions. The resulting hanger hole is of a geometric configuration in that it will accommodate most any support structure and the displaced portions are of a configuration in that they will not "hang up" or "dig" into the support structure. These features permit ease of fabrication and placement of the bag over a support device.

13 Claims, 7 Drawing Figures

FLEXIBLE BAG WITH RECESSED SCRAPLESS HANGER

BACKGROUND OF THE INVENTION

This invention relates to a hanger construction for a flexible and disposable plastic container for medical fluids which is easily fabricated and attached to a support hanger for purposes of administering fluids. More particularly, the invention relates to a scrapless hanger construction for a plastic bag for intravenous fluid which is fabricated in a manner such that an aperture and hanger portion is provided within the confines of the bag and the aperture is fabricated from tear and hinge lines so that the resulting tear-away tabs forming the aperture will remain in a position displaced from bag surface.

Flexible plastic bags are preferred by many as a container and delivery means for medical fluids. A problem which arises in using such plastic bags is their attachment to a hanger support. In many instances, the hanger portions become attached to the bag itself making it difficult to separate. Such could be the case with a bag of the type disclosed in U.S. Pat. Nos. 3,992,706 and 3,205,889 as well as U.S. Pat. Nos. 4,049,033 and 3,915,212. Attempts to eliminate this problem is the subject of U.S. Pat. No. 4,199,062. Placement of a hanger hole within the confines of a flexible container is one manner of eliminating the problem of the hanger portion becoming adhesively secured to the bag body. Containers of this type are shown in U.S. Pat. Nos. 3,529,598 and 4,027,842 as well as U.S. Pat. No. 4,105,028. However, these patents are concerned with containers which are not intended to have the container liquid surround the hanger hole portion and do not have the hanger aperture and bag designed so that the hanger hole is both recessed and self-supporting when the bag is filled with fluid and grasped for placement on a support hanger.

Recently, containers with recessed hanger apertures have been illustrated at page 72 in *Plastics World,* May, 1979 by Cryosan Ltd. of Hyde Park, Mass., and a unit of this type has been marketed by Baxter Travenol of Deerfield, Ill. Problems arise even in these types of containers in that scrap pieces are produced, the section of the bag forming the hole is not easily torn away, or the hanger slit or aperture will not accommodate a wide variety of hanger hooks.

It is an advantage of the present invention to provide a hanger portion in a flexible bag for medical fluids wherein the hanger portion will be formed without scrap. Other advantages are a flexible plastic solution container with a recessed hanger portion which can be fabricated so as to produce a hanger construction wherein the aperture can be readily formed by tearing away portions of the bag; a flexible container which by means of the hinging of the tear-away portions will not subsequently obstruct the aperture during placement on a hanger hook or engage it in a manner to prevent smooth passage thereover; and a scrapless hanger construction for a flexible solution container which can be produced at a minimum of cost.

SUMMARY OF THE INVENTION

The foregoing advantages are accomplished and the shortcomings of the prior art are overcome by the present hanger construction for a flexible, collapsible container for medical fluids as disclosed herein which affords a scrapless, recessed hanger aperture. The body section of the container is composed of a flexible, inert plastic material defining front, back, side and opposing end wall portions. A hanger section is provided at one end and is disposed within the the confines of one of the end wall portions. It has a planar surface and defined by tear and hinge lines. The tear line provides a tab portion which is displaced from the planar surface to result in a hanger aperture. The hanger section of the container is positioned so that when the container is filled with medical fluid, it is surrounded on both sides thereof with fluid. This results in the aperture assuming an upright position and placement of the aperture on a support device is facilitated. In a preferred manner, the aperture is formed from a preweakened line in the hanger section having a shape substantially in the form of the number "3" placed face downwardly or with the longitudinal axis thereof lying substantially transverse to an axis of the container extending between the opposing end wall portions. An initial tear point is provided in the central portion of the "3" with hinge lines formed between the central portion and the ends of the cut line. A tearing along the cut line results in two tabs which are biased outwardly from the bag or hanger surface. The resulting aperture will accommodate hanging devices of various types without the resulting tabs "digging into" the hangers. The apertures can be formed using standard materials and fabrication equipment, yet without any scrap material being formed.

BRIEF DESCRIPTION OF THE DRAWINGS

A better understanding of the flexible, collapsible container of this invention will be had by reference to the following description together with the accompanying drawings, wherein.

DESCRIPTION OF AN EMBODIMENT

Figure 1:
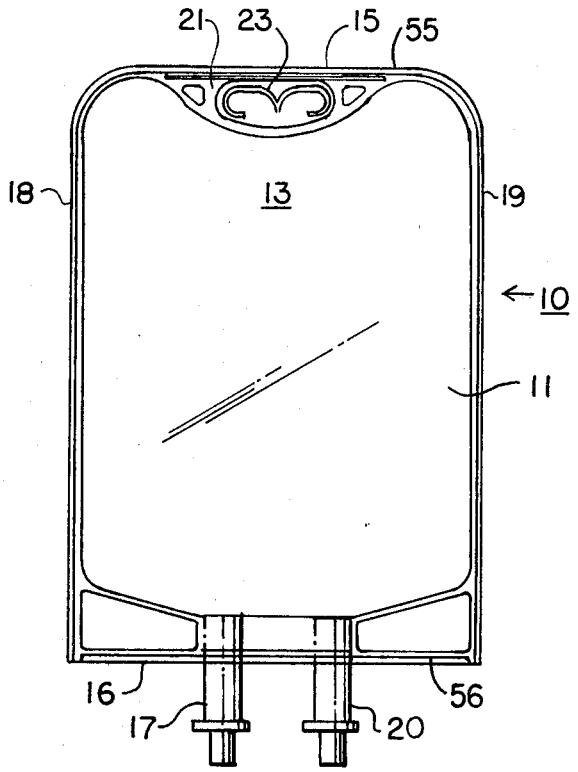
FIG. 1 is a view in side elevation showing the hanger construction of this invention in a flexible collapsible container immediately after fabrication and in an unfilled condition.

Referring to the drawings, flexible container 10 incudes a body section 11 which is formed by peripherally heat sealing two sheets of plastic material to form a front and back wall 13 and 14, respectively. The peripheral heat seals will provide end walls 15 and 16 as well as side walls 18 and 19. A hanger section 21 is provided in bag 10 adjacent upper end wall 15 and in the end wall portion.

Figure 3:
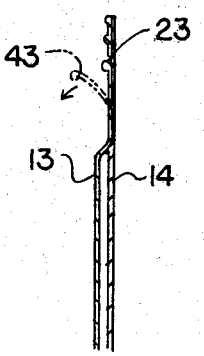
FIG. 3 is a view in vertical section taken along line 3—3 of FIG. 2.

As best seen in FIG. 3, the hanger section 21 includes a preweakened or tear-line 23 which is substantially in the form of the number "3" turned face downwardly and toward the inside of the bag. It is disposed within the confines of an outer rib 22 which is substantially "C" shaped. Tear line 23 is preferably formed with varying radii of curvature. Referring to one-half of the tear line, it will have the following radii as indicated by the following:

| Number | Radius of Curvature |
|---|---|
| 30 | ⅜ inch |
| 31 | 3/16 inch |
| 35 | .04 inch |

The same above-listed dimensions will apply for the corresponding other half of the figure "3" as it is a mirror image. The central portion of the tear line 23 will form an initial tear point 28. Tear line 23 will terminate at those points designated 36 and 37. Hinge lines 40 and 41 extend between points 36 and 37 and central tear point portion 28 as will be later explained in the Operation. Surrounding rib 22 will have a radius of curvature of ¼ inch at the curved portion indicated at 32. Curved seal line 38 will have a radius of curvature of 1-57/64 inch at that point indicated by numeral 33. At point 34, it will be 1-53/64 inch.

Extending from the opposing end of bag 10 are two tubular ports or passageways 17 and 20 which extend through end wall 16. They can be sealed in bag 10 at the same time that hanger section 21 is formed with tear line 23.

Figure 4:
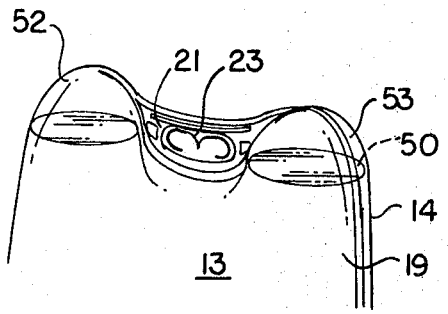
FIG. 4 is a partial perspective view of the container shown in FIG. 1 but in a filled condition.

As best seen in FIG. 4, bag 10 is shown in a filled condition with medical fluid 50 such as an I.V. solution. When bag 10 is filled, front and back walls 13 and 14 will extend outwardly to result in container 10 having two tubular portions 52 and 53 surrounding the hanger section 21. As a result, hanger section 21 will assume an upright position for ease of placement on a hanger support.

OPERATION

Container 10 is fabricated by heat sealing together at the periphery two sheets of polyvinylchloride plastic material. The sealing process will provide sealing seams 55 and 56 which provide end walls 15 and 16 as well as side walls 18 and 19. Further, the sealing procedure will at the same time provide hanger section 21 with a reinforcing rib or bead 24 as well as reinforcing portions 26, 27 and rib 22 which are formed by sealing together adjacent portions of front and back walls 13 and 14. Tear line 23 will be provided at the same time by partially die cutting through the sealed hanger portion 21. End wall 16 will be formed at the same time and in the same manner, with tubular ports 17 and 20 sealed therein. Bag 10 will be filled in the usual manner with ports 17 and 20 being subsequently sealed with appropriate pierceable diaphragms.

Figure 2:
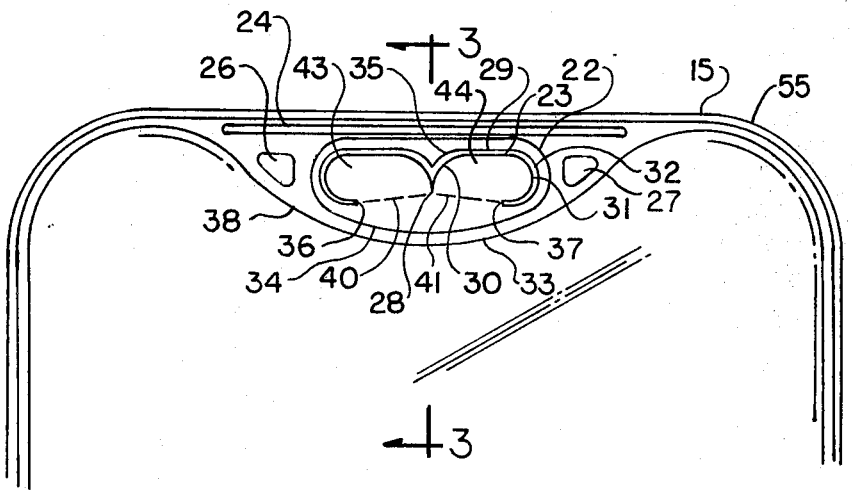
FIG. 2 is an enlarged, partial, detailed view showing the hanger construction in the container of FIG. 1.
Figure 5:
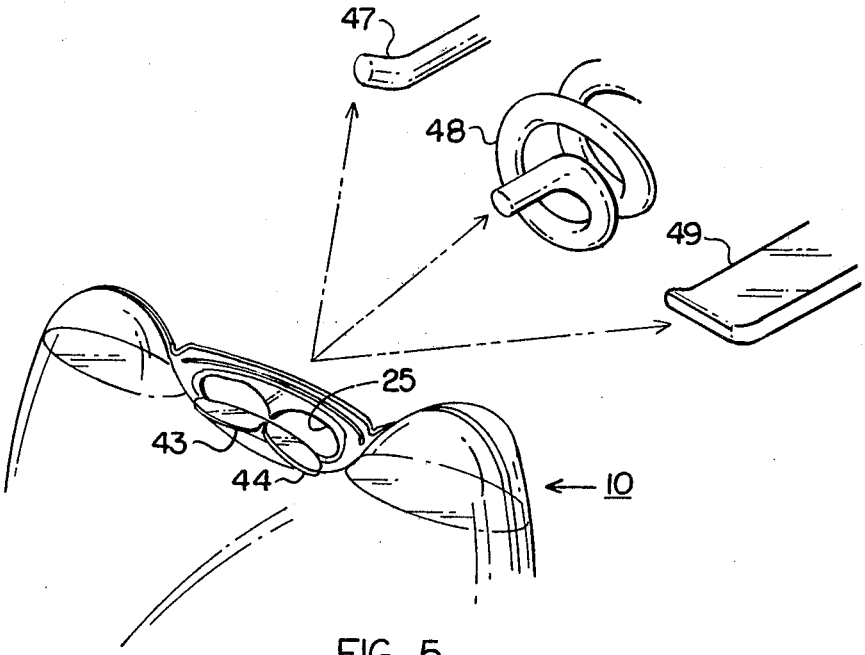
FIG. 5 is a partial perspective view of the hanger construction of this invention in a filled container and positioned for placement on a variety of support hangers.
Figure 6:
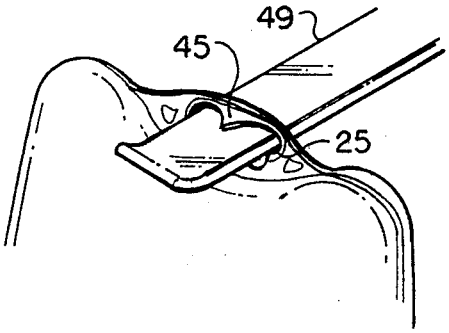
FIG. 6 is a view similar to FIG. 5 illustrating the placement of the container on a particular support hanger.
Figure 7:
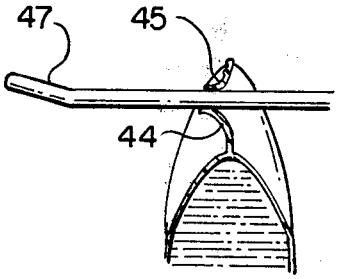
FIG. 7 is a view in side elevation showing the container and hanger construction of FIG. 6 and depicting the ease of movement of the hanger construction over the support.

When it is desired to hang the filled bag 10 from a support such as 47, 48 or 49, a force will be exerted at point 28 to initiate a tearing of tear line 23. This can conveniently be effected by finger pressure exerted from the back of hanger section 23 toward the front and viewed in FIGS. 1 and 2. When the appropriate tearing is effected, two tab portions 43 and 44, substantially in the form of petals, will result as shown in FIG. 5. There will also be formed a small oppositely positioned and pointed flap portion 45. It should be stated that the ends 36 and 37 of tear line 23 are spaced from the central tear point 28 at a distance of 0.531 inch and at a slight downward angle. This results in hinge lines 40 and 41 for tabs 43 and 44, respectively. The spacing and angle are important in that once the tabs are formed the angled hinging will effect a slight biasing force outwardly from the bag or hanger surface. This is indicated in FIG. 3. In this manner, the bag 10 can be placed on a hanger such as 47, 48 or 49 by means of the resulting aperture 25 (see FIG. 5). Another advantage in the placement of hanger section 21 on a support is that tabs 43 and 44 will not "hang up" or "dig into" the hanger support while hanging or removing the bag. This is illustrated in FIG. 7 and is accomplished by constructing tabs 43 and 44 of sufficient height (as measured from hinge lines 40 or 41 to straight section 29 of tear line 23) to permit a slight bending near the upper edge.

In one embodiment, the two sheets of thin plastic forming front and back walls 13 and 14 will have a width of 5½ inches with the length beng 8 inches. Tear point 28 is spaced a distance of ½ inch from end wall 15 and reinforcing portions 26 and 27 are placed a distance of about 1 inch from tear point 28. Reinforcing rib 24 is preferably 2.8 inches in length. Hanger section 21 with tear line 23 can be employed with any plastic bag normally used for medical solutions. These could be bags having a 50 ml to 3,000 ml capacity. The dimensions given for tear line 23 including the radii of curvature could be the same irrespective of the bag size. It will be appreciated that in those instances where the bag size is of 2,000 ml capacity or smaller, the tabs 43 and 44 can serve an additional function in being used as a holding means when placing the bag and aperture 25 on a hanger support. Irrespective of the bag size, it will be appreciated that because of the configuration of aperture 25 as determined by tear line 23, various types of hangers can be used for support such as rod 47, pig tail 48 or bar 49.

The preferred resin for fabricating container 10 from plastic sheet material is polyvinylchloride. However, other resins such as polypropylene, polyethylene or polyesters could be employed.

It will thus be seen that through the present invention there is provided a hanger construction for a flexible container for I.V. fluids which is easily fabricated and placed on a hanger device. The hanger construction of this invention can be fabricated from standard equipment and without forming any scrap material. The aperture formed by the described tear line can accommodate hangers of various types and at the same time results in projecting tabs which extend away from the bag surface and will not "dig into" the hanger surface. All of the foregoing is accomplished in a container which can be fabricated in a manner which does not employ additional components and does not result in increased costs.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

We claim:

1. A scrapless hanger construction for a flexible collapsible container for medical fluids composed of a flexible, inert, plastic material, said container comprising:

a body section defined by front, back, side and opposing end wall portions;

a hanger section provided at one end and disposed within the confines of one said end wall portion, said hanger section having a planar surface and defined by tear and hinge lines;

said tear line defined by a curved central tear portion terminating in a tear point, said tear line further including oppositely positioned straight portions and curved portions terminating at points spaced from but facing said tear point and at an upwardly extending angle to provide said hinge line with respect thereto to provide two tab portions which are easily displaced from said planar surface to result in a hanger aperture;

said hinge line further constructed and arranged to provide an outward biasing of said tab portions; and a tubular passageway extending from the opposing end wall portion and in communication with the inside of said body section;

so that when it is desired to support said container from a support hanger, said tab portions are easily displaced from said planar surface and said hanger section will be accommodated by said hanger aperture without interference from said tab portions.

2. The hanger construction for a flexible, collapsible container as defined in claim 1 wherein said tear line is defined by a configuration substantially resembling the figure "3", with the longitudinal axis of the "3" lying substantially transverse to an axis of said container extending between said opposing end wall portions.

3. The hanger construction for a flexible, collapsible container as defined in claim 2 wherein the central portion of said "3" includes a double curved portion provided by said tear lines, terminating in a pointed portion to thereby effect a tear starting point.

4. The hanger construction for a flexible, collapsible container as defined in claim 3 wherein said body section is fabricated from two opposing sheets of said plastic material.

5. The hanger construction for a flexible, collapsible container as defined in claim 3 wherein said body section is constructed and arranged to provide two tubular portions opposite said hanger section in open communication with the inside of said body section.

6. The hanger construction for a flexible, collapsible container as defined in claim 3 wherein said plastic material is polyvinylchloride.

7. The hanger construction for a flexible, collapsible container as defined in claim 3 wherein the configuration of said opposing sheets is substantially rectangular with the shortest dimension being from side to side.

8. The hanger construction for a flexible, collapsible container as defined in claim 3 wherein said hinge line extending between the central portion of said "3" and the termination points thereof is spaced a sufficient distance from the straight portions to provide tab portions of a size to permit a bending thereof when engaged by said support hanger.

9. The hanger construction for a flexible, collapsible container a defined in claim 8 further including a reinforcing rib positioned between said tear lines and the periphery of said container.

10. The hanger construction for a flexible, collapsible container as defined in claim 3 further including reinforcing members placed outwardly of those portions of the tear lines defining opposing sections of the "3" opposite the central portion.

11. The hanger construction for a flexible, collapsible container as defined in claim 10 wherein the tear line portions are varying radii of curvature.

12. The hanger construction for a flexible, collapsible container as defined in claim 3 further including a rib member partially surrounding said tear lines.

13. A scrapless hanger construction for a flexible collapsible container for medical fluids composed of a flexible, inert, plastic material, said container comprising:

a body section defined by front, back, side and opposing end wall portions;

a hanger section provided at one end and disposed within the confines of one said end wall portion, said hanger section having a planar surface and defined by tear and hinge lines;

said tear line defined by a curved central tear portion terminating in a tear point, said tear line further including oppositely positioned straight portions and curved portions terminating at points spaced from but facing in the direction of said tear point to provide a hinge line with respect thereto and two tab portions which are easily displaced from said planar surface to result in a hanger aperture;

said hinge line constructed and arranged to provide an outward displacement of said tab portions; and a tubular passageway extending from the opposing end wall portion and in communication with the inside of said body section, so that when it is desired to support said container from a support hanger, said tab portions are easily displaced from said planar surface and said hanger section will be accommodated by said hanger aperture without interference from said tab portions.

* * * * *

UNITED STATES PATENT AND TRADEMARK OFFICE

CERTIFICATE OF CORRECTION

PATENT NO. : 4,368,765

DATED : January 18, 1983

INVENTOR(S) : Mark E. Larkin, et al.

It is certified that error appears in the above—identified patent and that said Letters Patent is hereby corrected as shown below:

Column 5, line 50, Claim 6 should read:

container as defined in claim 4 wherein said plastic

Signed and Sealed this

Fifth Day of April 1983

[SEAL]

*Attest:*

GERALD J. MOSSINGHOFF

*Attesting Officer*

*Commissioner of Patents and Trademarks*